US012723209B2

(12) United States Patent
Wizenberg

(10) Patent No.: US 12,723,209 B2
(45) Date of Patent: Sep. 1, 2026

(54) PRODUCTION METHOD OF FUEL ADDITIVE, FUEL ADDITIVE AND MIXTURE OF DIESEL AND FUEL ADDITIVE

(71) Applicant: SINGLE CRAFT S.A., Cidade de Panama (PA)

(72) Inventor: Hugo Wizenberg, São Paulo (BR)

(73) Assignee: Hugo Wizenberg, SP (BR)

( * ) Notice: Subject to any disclaimer, the term of this patent is extended or adjusted under 35 U.S.C. 154(b) by 0 days.

(21) Appl. No.: 18/463,866

(22) Filed: Sep. 8, 2023

(65) Prior Publication Data

US 2024/0182805 A1 Jun. 6, 2024

(30) Foreign Application Priority Data

Dec. 5, 2022 (BR) ..... 10 2022 024845 1

(51) Int. Cl.

| | |
|---|---|
| ***C10L 1/18*** | (2006.01) |
| ***C10L 1/10*** | (2006.01) |
| ***C10L 1/12*** | (2006.01) |
| ***C10L 1/182*** | (2006.01) |

(52) U.S. Cl.

CPC ..... *C10L 1/1817* (2013.01); *C10L 1/10* (2013.01); *C10L 1/125* (2013.01); *C10L 1/1258* (2013.01); *C10L 1/1824* (2013.01); *C10L 2200/0446* (2013.01); *C10L 2290/18* (2013.01); *C10L 2290/34* (2013.01); *C10L 2290/36* (2013.01); *C10L 2290/38* (2013.01)

(58) Field of Classification Search

CPC ..... C10L 1/10; C10L 1/125; C10L 1/1258; C10L 1/1817; C10L 1/1824; C10L 2200/0446; C10L 2290/18; C10L 2290/34; C10L 2290/36; C10L 2290/38

See application file for complete search history.

(56) References Cited

U.S. PATENT DOCUMENTS 4,780,287 A * 10/1988 Zeff ..... B01J 19/123 422/236
5,186,907 A * 2/1993 Yanagi ..... B01J 19/123 422/186.3
2018/0037832 A1* 2/2018 Horst ..... C10L 10/00
2018/0037833 A1* 2/2018 Horst ..... C10L 1/1824

FOREIGN PATENT DOCUMENTS

BR 112019002556-1 B1 5/2022

* cited by examiner

*Primary Examiner* — James C Goloboy
(74) *Attorney, Agent, or Firm* — HSML P.C.

(57) ABSTRACT

The present invention discloses a method of producing a fuel additive comprising the following steps: mixing alcohol in water; homogenize the mixture under the influence of mechanical waves, preferably ultrasound and specific pressure; adding an oxidizing solution to the mixture; exposing the mixture to electromagnetic radiation, preferably UV; perform electrolysis with molecular sieve with specific porosity; exposing the mixture from the previous step to radiation in the microwave spectrum; and atomize the mixture in the medium of specific alcohols. The present invention aims to provide an additive with the ability to increase the amount of oxygen in the combustion reaction inside a combustion chamber. Another objective of the present invention is to provide a fuel additive capable of generating, after the combustion reaction, nitrous compounds for lubricating the metallic surfaces of the engine.

10 Claims, 7 Drawing Sheets

AHHR for diesel and test fuel with Oxon2 at 21% oxygen concetration

PRODUCTION METHOD OF FUEL ADDITIVE, FUEL ADDITIVE AND MIXTURE OF DIESEL AND FUEL ADDITIVE

FIELD OF INVENTION

The present invention fits into the field of fuels for internal combustion engines, more specifically in the field of additives for fuels for internal combustion engines.

PRIOR ART

Electro oxidation is widely publicized to enable continuous cells, such as batteries, from the generation of energy resulting from the oxidation of low molecular weight alcohol chains.

The content revealed in the state of the art, however, is only restricted to establishing systems and continuous reactions so that the effect of radiation and electrolysis promotes electronic actions with donations of ions and the subsequent generation of electrical energy.

Patent BR112019002556-1 discloses an additive of ethanol and water, mixed in a metallic solution, irradiated with electromagnetic waves that are then atomized. BR112019002556-1, however, does not describe the steps involving wave frequency in the ultrasound range, does not describe homogenization, does not describe the use of a molecular sieve, or define the ph, or acidity and finally does not activate alcohol in a process of encapsulation.

Unlike the present invention, BR112019002556-1 would not result in an increase in $O_2$ and $CO_2$ concentrations, which results in $NH_2$—C, which increases engine lubrication.

Unlike the solutions mentioned above, the present invention does not concern the generation of electrical energy, but the concept of stabilizing a molecule and low molecular weight alcohol, C2 to C5, defining the size of its particles in the form of nanometric dispersion in an extremely polar environment, the definition of intermolecular forces between molecules of different particle sizes, their standardization through specific wave frequencies and working in super oxidant solution over a certain nanometric waveband to enhance the chemical reactions described here and, immersed in a controlled medium of acidity, with effective increase of ions, to protect and characterize this alcohol in a colloidal nanometric dispersion with the characteristic in non-polar means, in the form of chains of hydrocarbons, C12-C13-C14-C15, known as sources of combustion, fuels, in the action of pressure and temperature, initiate the increase in the formation of carbon dioxide and thus, in the stoichiometric equation with air, increase the repulsion to nitrous compounds, in the combustion system, increasing the formation of carbon dioxide.

Objectives

The present invention aims to present, in an applied way, the concepts of oxygen donor and concentration of molecular forces in an allylic alcohol. Such an application involves the modification of allyl alcohol by wave frequency in an oxidizing medium followed using an electronic solution to coordinate the electronic charges and maintain the stability of the alcohol molecule under high pressure.

The present invention aims to provide an additive with the ability to increase the amount of oxygen in the combustion reaction inside a combustion chamber.

Another objective of the present invention is to provide a fuel additive capable of generating, after the combustion reaction, nitrous compounds for lubricating the metal surfaces of the engine.

BRIEF DESCRIPTION OF THE INVENTION

The present invention discloses a method for producing a fuel additive comprising the following steps:

a) mix alcohol in water.
b) homogenize the mixture from step a) under mechanical waves, preferably ultrasound and specific pressure.
c) adding an oxidizing solution to the mixture in step b).
d) apply electromagnetic radiation, preferably UV to the mixture of the previous steps.
e) perform electrolysis with molecular sieve with specific porosity.
f) applying microwave spectrum radiation to the mixture from the previous step.
g) atomize the mixture to specific alcohols.

The method for producing a fuel additive disclosed by the present invention predicts the use of demineralized and deionized water.

Said method for producing a fuel additive establishes the water concentration in step a) is between 1 and 4% by volume.

The method for producing a fuel additive disclosed by the present invention indicates that the alcohol molecules in step a) are C1-C5 molecules.

The said method for producing a fuel additive establishes the alcohol concentration in step a) is between 99 and 96% by volume.

The method for producing a fuel additive disclosed by the present invention indicates that the alcohol molecules of molecule a) are at least one of ethyl, propyl, butyl, allylic or hexyl alcohols.

Said method for producing a fuel additive reveals that the mechanical waves of step b) are caused by a piston.

The method for producing a fuel additive of the present invention establishes that the energy deposited via ultrasound in step b) is comprised between 0.5 and 4.0 KW (0.5 and 4 kJ/s) at a frequency between 20 and 100 kHz. The energy is deposited directly in the homogenized solution, through a device inserted in the solution. The application causes turbulence in the solution.

The present invention, which discloses a method for producing a fuel additive, establishes that the pressure used in step b) is comprised between 300 and 700 ATM.

The method for producing a fuel additive of the present invention establishes that the oxidizing solution of step c) is hydrogen peroxide.

Said method for producing a fuel additive provides that the concentration of hydrogen peroxide in the solution of step c) is between 0.5 and 5% by volume.

The present method for producing a fuel additive establishes that the energy deposited via UV in step d) is preferably comprised between 180 and 380 nm to frequencies reaching up to $10^{18}$ Hz. The energy is deposited by beams at a distance equal to or less than 50 cm.

Said method for producing a fuel additive provides that the electrolysis of step e) is carried out in an acid medium of a solution of a molecular sieve, zeolite with pH in the range of 3.5 to 6.5.

The method for producing a fuel additive of the present invention determines that the cathode and anode are palladium and platinum in the electrolysis of step e).

The present method for producing a fuel additive determines that the electrolysis of step e) is established in a slightly acid medium, with a pH preferably between 3.5 and 6.5, more preferably between 4.5 and 6.2, even more preferably between 4.5 and 5.5.

Said method for production of a fuel additive uses metal ions in step e), which are at least one of zinc, iron, copper, nickel, platinum, and palladium.

The present method for production of a fuel additive provides that the energy deposited via microwaves in step f) comprises a wavelength between 200 and 300 nm, power preferably between 300 and 600 W (300 and 600 J/s) at a frequency of 300 to 800 MHz, the energy is deposited in the form of a beam applied to the homogenized solution at a distance equal to or less than 50 cm.

The present method for production of a fuel additive uses the atomization of step g), into a solution of alcohols between 700 and 3000 Dalton with at least 4 atoms of carbon and a maximum of 10 atoms of carbon in the repeating unit of the chain. In the context of the present invention, atomization is the process of breaking down a bulk liquid into a fine spray of droplets.

The present invention also discloses a fuel additive comprising alcohols, oxidizing solution and polar medium, having a flash point between 5 and 25 degrees Celsius, self-ignition between 350 and 500 degrees Celsius, boiling point between 50 and 100 degrees Celsius, specific gravity between 0.6 and 0.95, Zeta potential between −0.1 and −3 mV and electrophoretic mobility between −0.000001 and −0.00003 $cm^2/Vs$.

Said fuel additive establishes that alcohols are C1-C5 molecules, more specifically ethanol and methanol.

The present fuel additive provides that the oxidizing solution is hydrogen peroxide.

The fuel additive disclosed by the present invention states that the polar medium is water.

The present fuel additive comprises a flash point more specifically between 10 and 20 degrees Celsius, even more specifically at 15 degrees Celsius.

The fuel additive of the present invention comprises self-ignition more specifically between 350 and 480 degrees Celsius, even more specifically between 385 and 450 degrees Celsius.

The present invention discloses that the fuel additive comprises a boiling point more specifically between 60 and 90 degrees Celsius, even more specifically between 65 and 85 degrees Celsius.

The fuel additive of the present invention further sets specific gravity more specifically between 0.65 and 0.90, even more specifically between 0.75 and 0.85.

The present invention discloses a fuel additive comprising Zeta potential more specifically between −0.3 and −2.3 mV, even more specifically between −0.5 and −1.9 mV.

The fuel additive of the present invention comprises electrophoretic mobility more specifically between −0.000003 and −0.000018 $cm^2/Vs$, even more specifically between −0.000004 and −0.000015 $cm^2/Vs$.

The present invention also discloses a mixture of diesel and fuel additive comprising API gravity between 3° and 50° API, flash point between 50 and 80 degrees Celsius, cetane number between 45 and 63, kinematic viscosity between 1.0 and 7 $mm^2/s$, electrical conductivity between 100 and 150 pS/m, density between 750 and 900 $kg/m^3$ and lubricity between 50 and 460 μm.

Said mixture of diesel and fuel additive comprises API gravity more specifically between 35 and 45° API, even more specifically between 37 and 43° API.

The present mixture of diesel and fuel additive comprises a flash point more specifically between 55 and 70 degrees Celsius, even more specifically between 55 and 65 degrees Celsius.

The mixture of diesel and fuel additive disclosed by the present invention comprises cetane numbers more specifically between 45 and 60, even more specifically between 45 and 58.

Said mixture of diesel and fuel additive comprises a boiling point more specifically between 10 and 20 degrees Celsius, even more specifically at 15 degrees Celsius.

The present mixture of diesel and fuel additive comprises kinematic viscosity more specifically between 2 and 6 $mm^2/s$, even more specifically between 2 and 4.5 $mm^2/s$ measured per ASTM D445 at room temperature of 25° C.

The mixture of diesel and fuel additive disclosed by the present invention comprises electrical conductivity more specifically between 100 and 140 pS/m, even more specifically between 110 and 130 pS/m.

The present mixture of diesel and fuel additive comprises density more specifically between 750 and 850 $kg/m^3$, even more specifically between 800 and 850 $kg/m^3$.

Said mixture of diesel and fuel additive comprises lubricity more specifically between 50 and 350 μm, even more specifically between 50 and 250 μm measured by a wear scar diameter (WSD), according to ISO 12156-1 (High Frequency Reciprocating Rig—HFRR method) at 60° C. for 75 minutes under a load of 200 g. In the context of the present invention, lubricity refers to the friction-reducing and anti-wear properties of the fuel composition, which enhance the tribological performance at fuel injection system interfaces, reduce wear of moving components (including piston rings and cylinder walls), and contribute to improved combustion efficiency, thereby reducing unburned hydrocarbons and CO 2 emissions.

DETAILED DESCRIPTION OF THE INVENTION

Figure 1:
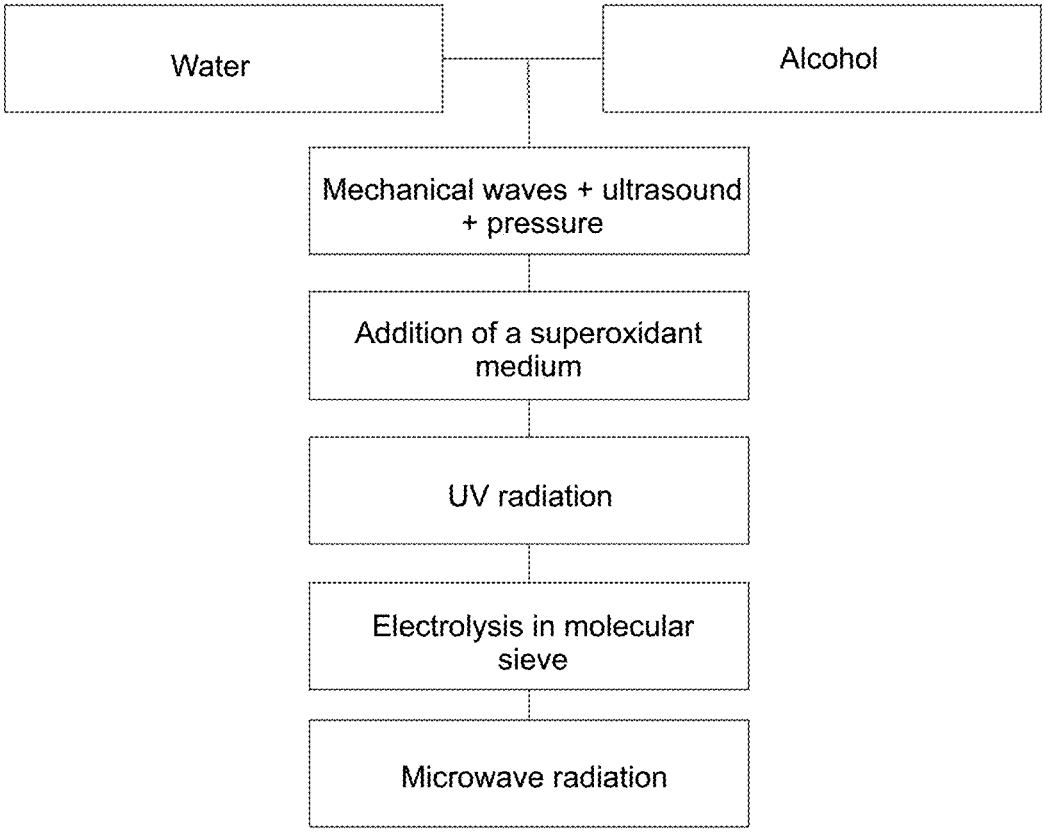
FIG. 1 shows a representative flowchart of the steps of the present invention.
Figure 2:
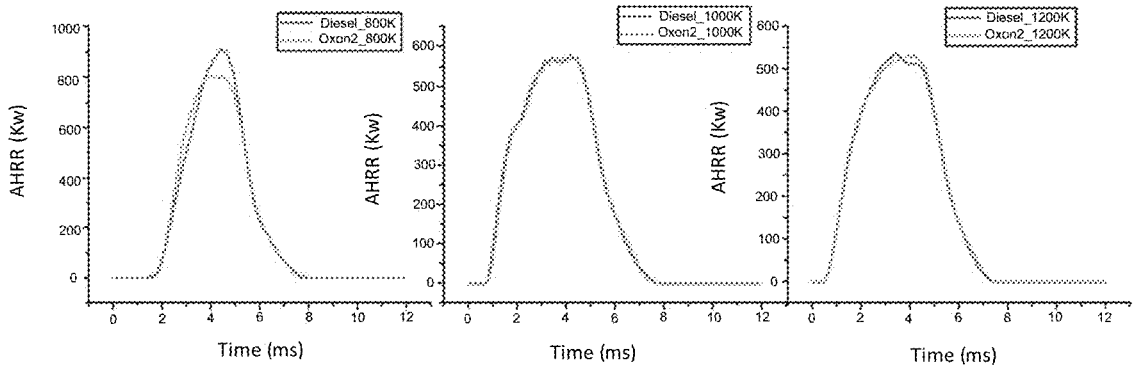
FIG. 2 shows a chart of the apparent heat release rate of a common diesel fuel and a diesel fuel with the present fuel additive.
Figure 3:
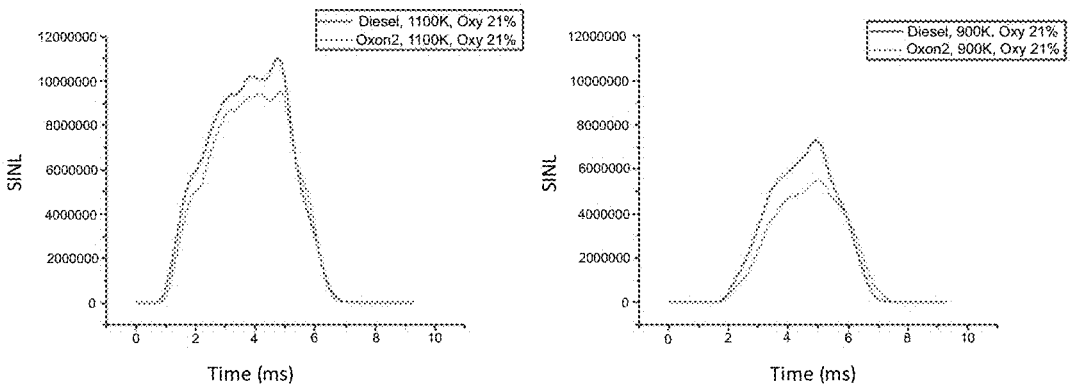
FIG. 3 shows a comparative chart of spatial integrated natural flame luminosity at 1100- and 900-degrees Kelvin and 21% oxygen, between Diesel and a diesel mixture with the present additive.
Figure 4:
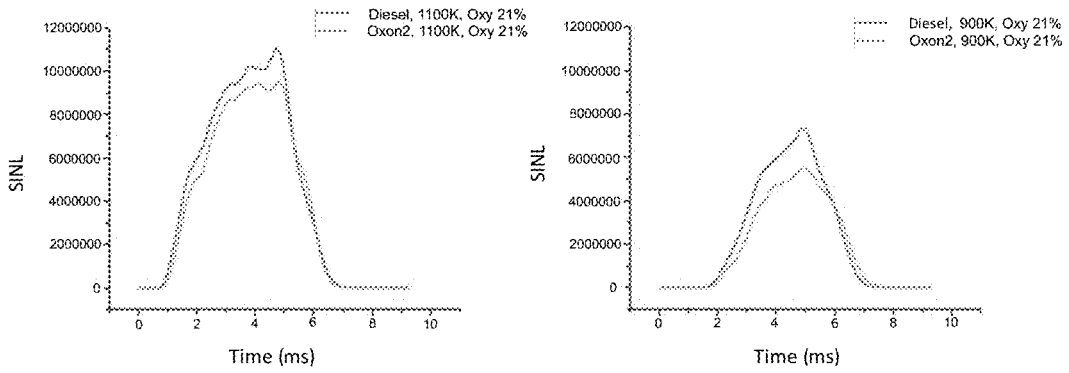
FIG. 4 shows a comparative graph of spatial integrated natural flame luminosity at 1100- and 900-degrees Kelvin and air with 21%, between Diesel and a Diesel mixture with the present additive.
Figure 5:
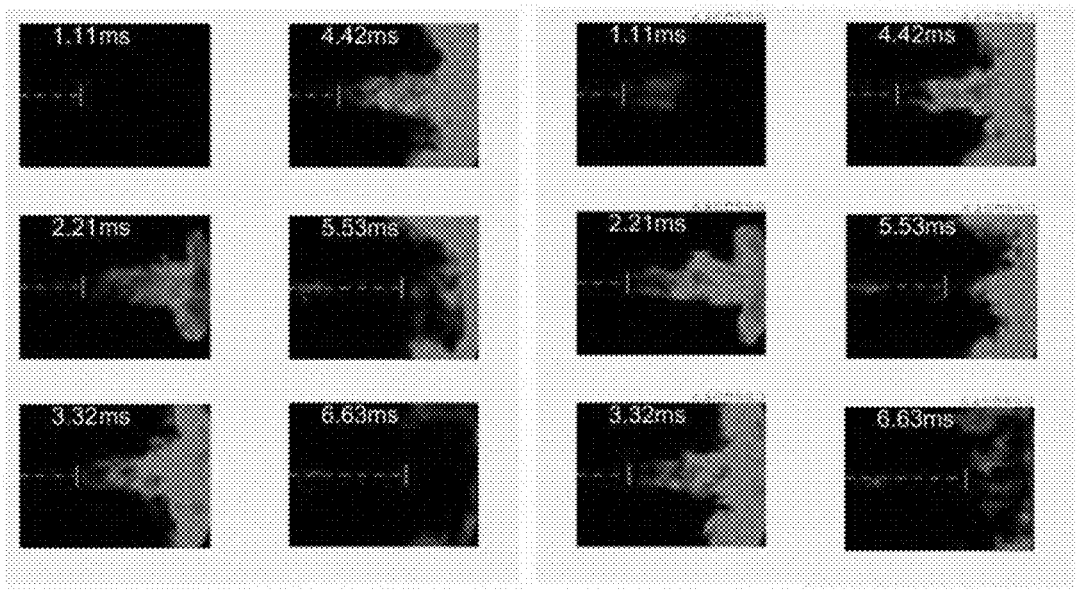
FIG. 5 shows a comparison between spatial integrated natural flame luminosity of diesel and a combination of diesel with the present additive at 1000 degrees Kelvin and air with 21% oxygen.
Figure 6:
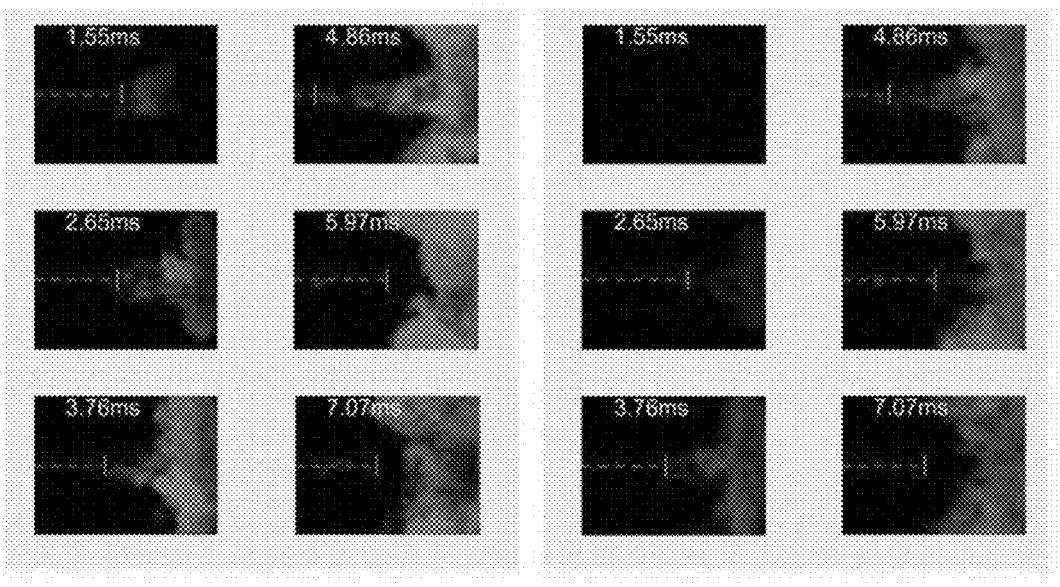
FIG. 6 shows a comparison between spatial integrated natural flame luminosity of diesel and a combination of diesel with the present additive at 1000 degrees Kelvin and air with 17% oxygen.
Figure 7:
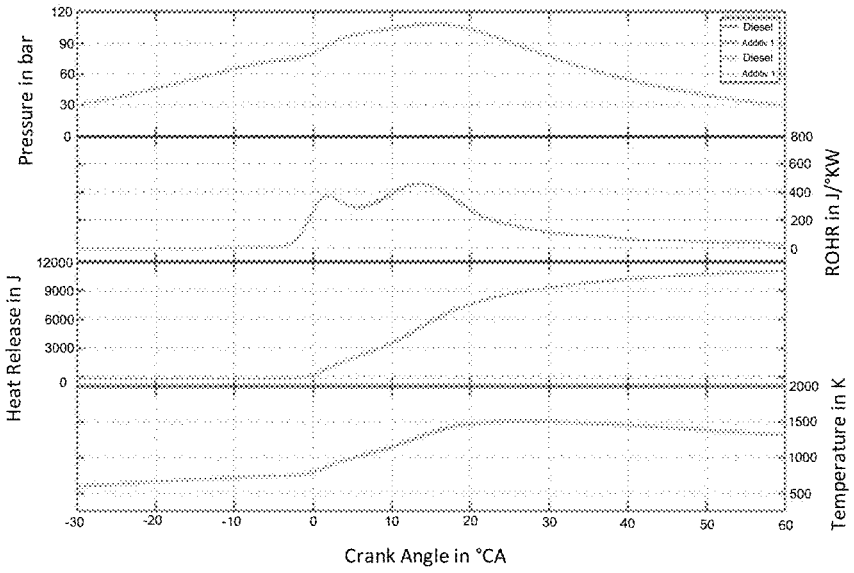
FIG. 7 shows charts of combustion chamber pressure, heat release rate, apparent heat, temperature as a function of crankshaft angle.
Figure 8:
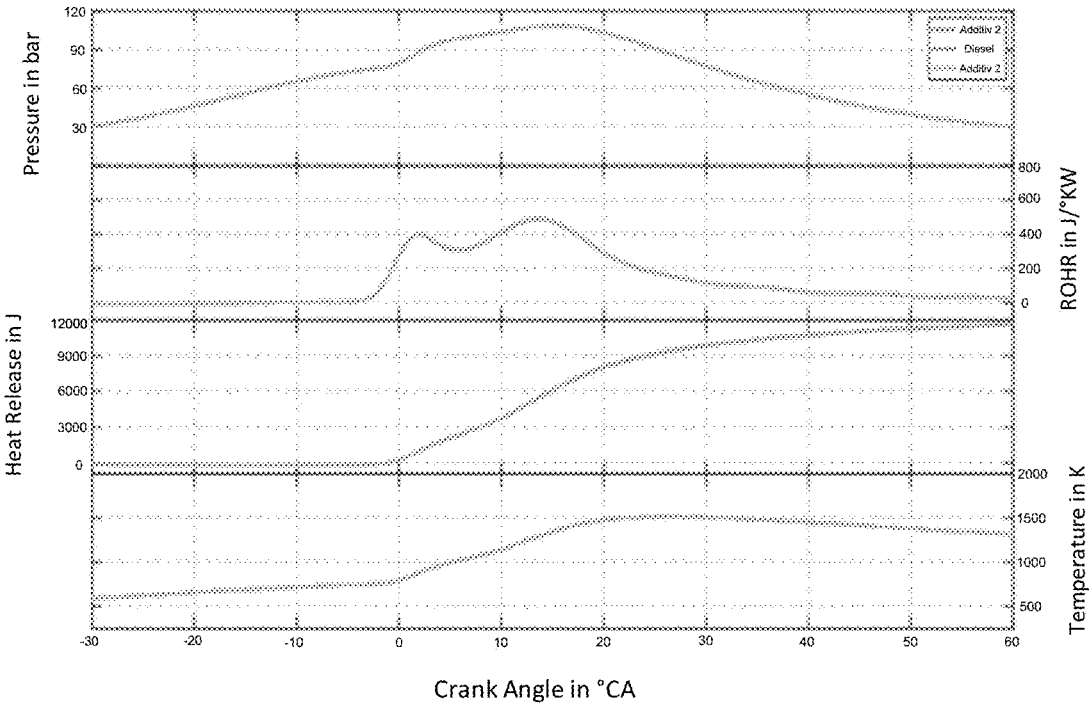
FIG. 8 shows charts of combustion chamber pressure, heat release rate, apparent heat, temperature as a function of crankshaft angle.
Figure 9:
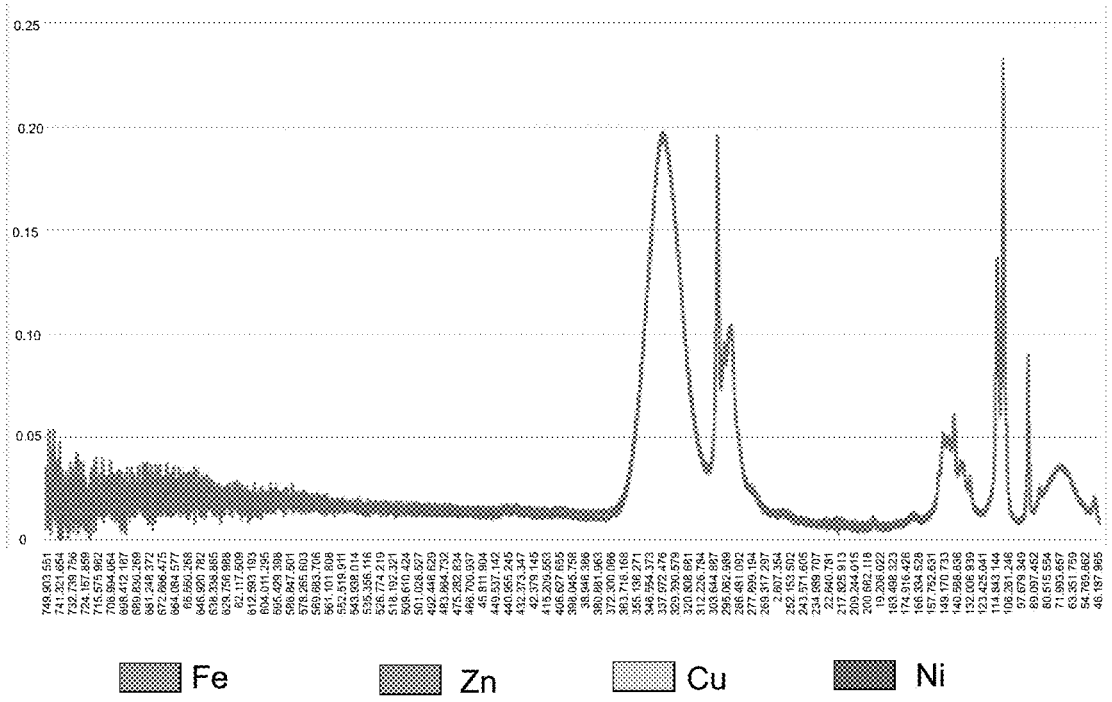
FIG. 9 shows a Fourier-transform spectroscopy. The equipment used to obtain the spectroscopy is an Agilent Instruments FTIR-5500 series.
Figure 10:
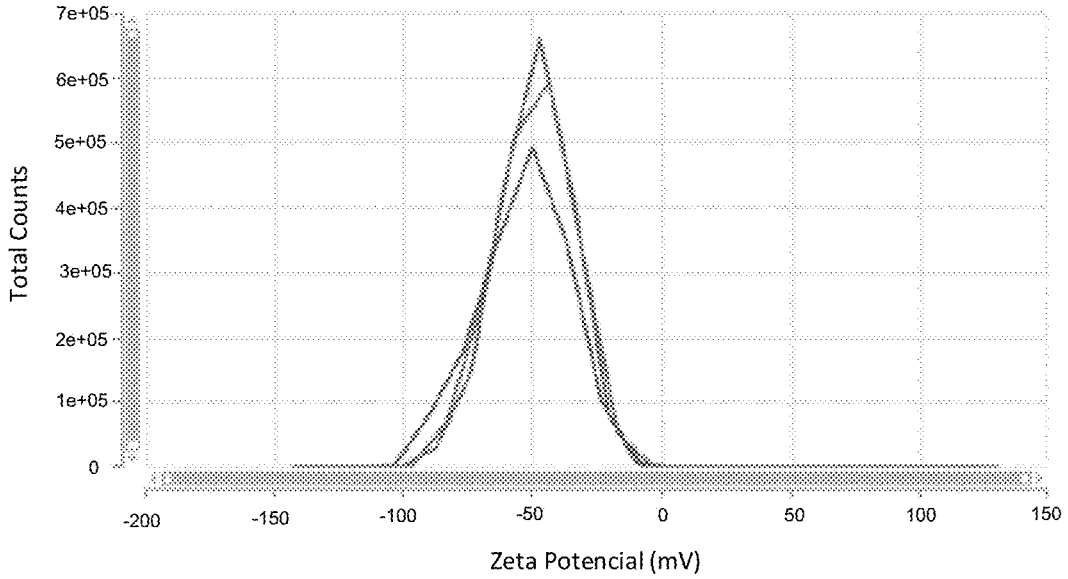
FIG. 10 shows a chart of the incidence of Zeta potential values. Zeta potential was obtained by Malvern Zetasizer Lab-0.3 nm-10 μm.
Figure 11:
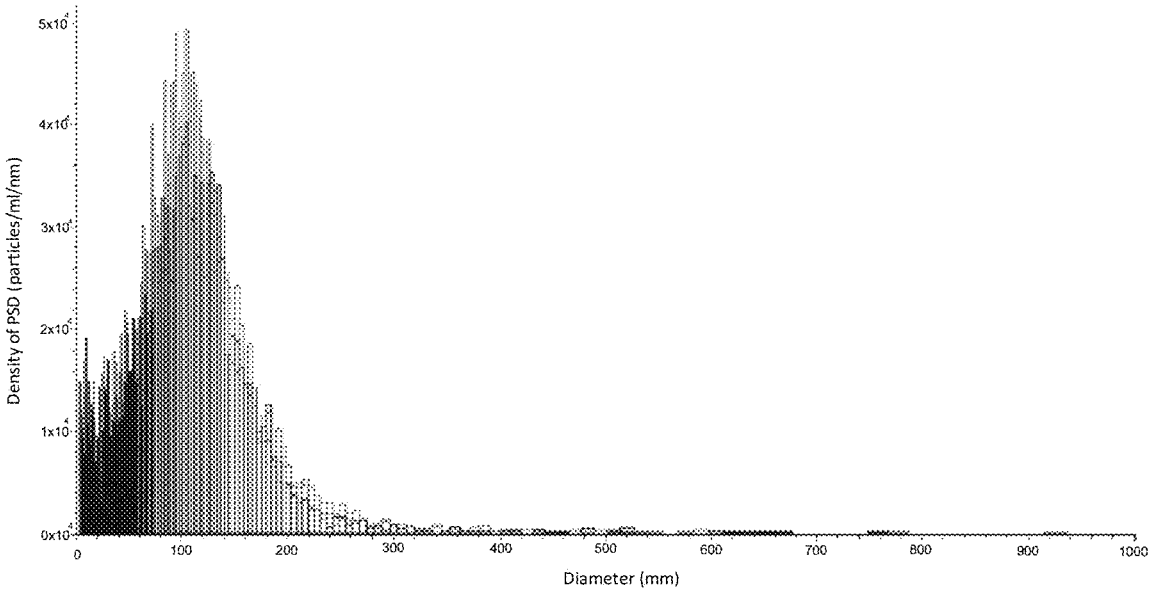
FIG. 11 shows a graph of the incidence of particle sizes in the solution.

The present invention uses some concepts, such as the modification in the oxygen donation characteristic throughout the combustion reaction, in the combustion chamber in systems, such as automotive vehicles, generators, locomotives, boats and ships.

The present invention allows numerous modifications and adaptations to the proposed means, creating a family of natural products with different molecular weights, based on natural oxygen donor alcohols and their substitutes, all of vegetable origin, as well as their modifications. The present invention also makes use of mineral media and chemical structures of higher molecular weight, known as polyalcohol in the form of polyols.

The characteristics of the present invention will be described below, including the reaction steps, some examples, and details of the processes.

The present invention deals with potentializing the concepts of partial and complete combustion through hydrocarbons in specific internal combustion chambers, designed for conventional systems such as the Diesel cycle and the Otto cycle, specifying the thermodynamic conditions, considering the action of the principles included in the process described here.

The principles are enhancement of intermolecular forces by atomic organization, radiation and electrolysis or electro-oxidation of a colloidal nanometer dispersion.

That said, the increase in intermolecular forces by atomic organization can be defined as the ability of a given structure to increase its intermolecular forces through atomic self-organization. Intermolecular forces can be defined as the capacity for electronic action, between atoms, in the form of molecular attraction or repulsion. Intermolecular forces can be divided into dipole-dipole, Van der Waals forces and hydrogen bonds. Intermolecular forces define the electrical potential of molecules. The greater its intermolecular forces, the greater its electrical potential.

Given the nature of intermolecular forces and self-organization of molecules, a specific wave frequency range can interfere with electrons in such a way as to cause an increase in intermolecular forces between miscible molecules of polar solvents with nonpolar solvents.

Through the oxidation of a colloidal nanometric dispersion, with defined particle size and frequency, it is possible to transform an alcohol molecule into an oxygen donor, increasing the formation of carbon dioxide during the combustion reaction with hydrocarbons through the mass balance of air and fuel.

To achieve this objective, the present invention comprises the following steps:

a) mixing alcohol in water, following a specific proportion.
b) homogenizing the mixture from step a) under mechanical waves, preferably ultrasound and specific pressure.
c) adding an oxidizing solution to the mixture in step b).
d) applying electromagnetic radiation, preferably UV to the mixture of the previous steps.
e) performing electrolysis with molecular sieve with specific porosity.
f) applying microwave spectrum radiation to the mixture from the previous step.
g) atomizing the mixture to specific alcohols.

In step a), the water is preferably demineralized and deionized. The alcohol is preferably selected to allow oxidation of even groups C2 and C4. Linear or branched alcohols can be used. It is noteworthy that branched alcohols require an additional step to eliminate acids from their respective alcohols.

Preferably, ethyl, propyl, butyl, allyl and hexyl alcohol are used. Longer-chain alcohols, especially allyl, are used due to their natural process resulting from the fermentation of alcohol into sugar, generating by-product alcohols of the type of isopropanol, n-propanol, isobutanol, amyl, isoamyl, 2-ethylhexanol, n-heptanol, isoheptanol and n-octanol. Thus, its dispersion in water favors the formation of butyl alcohol, which, like ethyl alcohol, will produce carbon dioxide in the combustion chamber during the combustion reaction.

Alcohol, ideally, is pure and anhydrous, with its purity in the range of at least 99.96%. In another embodiment, the alcohol can be free of water. The mixture comprises between 1 and 4% water and 99 to 96% alcohol. This mixture is homogenized by the action of a piston, with pressures between 300 and 500 atm. Homogenization occurs with particles with a maximum size in the range of 130 nm, preferably between 110 and 130 nm. The normal particle size distribution predicts 90% of the particles to be between 110 and 130 nm in this mixture.

The concentration of the particles is controlled using a particle size meter as well as their attraction potential, Zeta. The Zeta attraction potential, also called the electrokinetic potential, is the potential in the slip/shear plane of a colloid particle moving under an electric field. The electric potential of a surface is the amount of work that needs to be done to bring a positive unit charge from infinity to the surface without any acceleration. The Zeta attraction potential reflects the potential difference between the EDL (electric double layer) of electrophoretically mobile particles and the dispersant layer surrounding them in the slip plane. The Zeta attraction potential is measured by a Zetasizer, considering particles up to 0.1 nm.

Particle size is relevant not only for homogenization, but also for the proper functioning of the product. The smaller the size of the alcohol molecules, the more the "protection" of these molecules by water occurs. Small chain alcohols are preferable as the prevent the formation of acetic acid during the super oxidation step, due to their size and the presence of water.

In step b), when this mixture of alcohol and water is homogenized and subjected to ultrasound radiation, the alcohol and water molecules "explode" and function as a means of dispersion, where, due to the high molecular organization provided by the ultrasound waves, the formation of an organization analogous to a colloidal nanometric dispersion occurs. This suspension occurs momentarily and for a short period.

The particle size used in the colloidal nanometric dispersion is in the range between 60 and 120 nm, preferably between 80 and 100 nm.

The ultrasound frequency is expressly defined by the alcohol used. Ethyl alcohol uses a frequency between 20 and 30 kHz, propyl alcohol uses a frequency between 30 and 40 kHz, butyl alcohol uses a frequency between 40 and 50 kHz, allylic alcohol uses a frequency between 60 and 70 kHz, and hexyl alcohol uses a frequency between 70 and 90 KHz.

The time of exposure to ultrasound ranges from 20 to 40 minutes in solution, proportional to the energy generated by the previously mentioned ultrasound.

By increasing the molecular activity, it is possible to increase the electronic charge of oxygen as a function of the time of exposure to the super oxidant environment. In a preferred configuration, in step c), hydrogen peroxide is added to the mixture, as a super oxidant medium. Hydrogen peroxide is intended to increase the activity of oxygen with alcohol.

The hydrogen peroxide used varies from 20 to 70 volumes and its concentration in the process varies between 0.5 and 5%

The present invention works in the irradiation step in a super oxidant environment with pH between 6 and 8. In step d), the action of radiation in bands between 0 and 500 nm, more specifically between 100-300 nm, in a super oxidant environment, allows the displacement of oxygen molecules starting from the breaking of the hydroxyl bond.

The system is exposed to UV radiation between 1 and 5 minutes, maintaining the same energy already suggested.

In this system, with the increase of electronic load, it is necessary to define the exposure of this load through stability. For stability, self-organization under the action of pressure and under the action of an acid medium with excess of metal ions, under the action of two electrodes, one anode and one cathode, are essential factors. Self-organization occurs after the actions of wave frequencies and under homogenization action, leading to stability of maximum concentration of particle sizes in the same nanometer range in more than 90%, previously they were between 50 and 65%. This system known as self-organization is due to the homogeneity of the particle size after wave frequency action and homogenization under controlled pressure.

After this step, the electrochemistry takes place, in step e). Cathode and anode are added to the mixture, namely platinum and palladium.

To this principle of electrolysis, a slightly acid medium is established, having its pH between 3.5 and 6.5, preferably between 4.5 and 6.2, even more preferably between 4.5 and 5.5. The charge used is a 1.5 V battery.

Molecular sieve modified in an acid system, until the pH is maintained, this reaction of the sieve in an acid medium takes between 6 and 8 hours before being used in the process. The composition of the acid medium in the electrolysis described here in the present invention, configures the action of an electricity charge, in an ionic solution, of metallic ions in a type of bed in the form of a membrane, and these ions become extremely active and the present invention has its effective conclusion when the monodisperse increase in the anode. Organic acids such as oxalic, oleic, and modified phosphoric are preferably used.

Metal ions are at least one of zinc, iron, copper, nickel, platinum, and palladium.

The membrane is of the adsorber type, of the molecular sieve type, with the presence of palladium and platinum.

The electrical charge developed by the oxidation reaction is greater than −35 mV, preferably between −35 and −50 mV, and with polarity greater than 20, preferably between 22 and 35 mV.

In some countries, where gasoline or fuel in general is heavily filtered, it is common to use metals to increase the fuel's octane rating, serving as a catalyst during combustion. The role of metals in this process is completely different, being even removed before combustion.

In step f), microwave radiation is used to remove the metals used for electrolysis. Exposure to radiation in the microwave range is carried out between 10 and 15 minutes.

Said metals or metal ions are used only as catalysts and cannot form part of the product. The presence of metal particles can clog injector nozzles, in addition to causing their deposition on top of the pistons, disturbing the reaction, in addition to increasing the mass of the piston (mobile mass), which would cause loss of combustion efficiency.

Radiation in the microwave spectrum promotes segregation of the metal, which is then filtered out of the additive. Each metal used requires a specific microwave range for segregation. Equipment: Anton Paar Multiwave 3000 microwave oven—Particle size in nm/Power in Watt. The applied power varies depending on the concentration of metal ions present in the solution. The wavelength varies depending on the concentration of metals present in the solution.

For copper with a particle size in the range of 220 nm, 700 W are used. In the case of iron, with a particle size in the range of 262 nm, 950 W are used. In relation to manganese, with a particle size in the range of 254 nm, 350 W are used. For nickel, with a particle size in the range of 235 nm, 610 W are used. In the case of zinc, with a particle size in the range of 206 nm, 200 W are used. Regarding palladium, with particle size in the range of 270 nm, 240 W are used. For platinum, with particle size in the range of 265 nm, 500 W are used.

In step g), the product of step f) is atomized into a solution of alcohols with high molecular mass to avoid its evaporation. The alcohols with high molecular mass have a molecular weight between 700 and 3000 Dalton.

The transport and storage of the product between the stages of the process described in the present invention can be carried out in containers. A person skilled in the art can discern which is the best device to transport and store the product during the stages of the present invention.

The whole process aims to increase the concentration of oxygen in combustion. In partial combustion, between 50 and 60% of conversion into $CO_2$ effectively occurs and in complete combustion, above 85%. The combustion stoichiometry is 1:16.6. The difference with partial combustion is that when we incorporate oxygen donor agents, we reach almost complete levels of combustion, when we increase the formation of $CO_2$ in the internal combustion chamber. The maximum efficiency of a combustion process is when we reach the ratio of 1 kg mol of air being equal to kg/mol of fuel, in this case the ideal compression ratio is diesel (16:1), gasoline (15-16:1), alcohol (20:1) and so on.

In this way, the absence of the formation of nitrous oxides causes the formation of chains of nitrous hydrocarbons, $NH_2$—C and, in this way, the action of the antioxidant that could theoretically affect combustion, in the decrease of $CO_2$, starts to act together with the exit of combustion gases increasing the lubricity power when in contact with metal surfaces close to combustion gas outlet areas.

The present invention clarifies that the increase in the formation of $CO_2$ is exclusively due to the increase in the formation of Oxygen in its most active form, $O_{-2}$ and not due to the complete degradation of the alcohol molecule into $CO_2$ with the generation of electrical energy. The present invention, through the definition of the particle size, the time of action of the wave frequency in a super oxidant medium of the promotion of the stability of the electronic charge in a slightly acid medium, allows to present the means of initiation and propagation of the increase of $CO_2$ formation together with the fuel's hydrocarbon chain, causing the termination of the reactions to be due to the greater presence of oxygen and the greater amount of $CO_2$ formed in the combustion chamber.

The electronic charges formed are specific to the nanometric monodisperse so that together with the air inlet it increases the formation of carbon dioxide, unbalances and does not allow the formation of nitrous oxides, alters the stoichiometry of the air-fuel reaction by directly increasing the volume of oxygen and thus increase the repulsion of the combustion medium the interferences of nitrogen in these reactions.

Due to the fact that the process is associated with the particle size of the dispersion, is associated with irradiation in a super oxidizing environment and the donation of ions in an electronic medium for the controlled increase in the formation of $O_{-2}$, we have control of the emission of pollutants from the chamber of combustion such as $NO_x$ and $CO_x$, the non-formation of particulate matter due to the proper adjustment of the air+fuel reactions by increasing oxygen in the fuel and thus, we have the data below for the comparison of combustion gases without the action of the oxygen donating agent of the present invention, with different types of fuels, different types of diesel and OTTO combustion cycles, and consequently the measurements showing the reduction of pollutants proportionally to the increase in the formation of carbon dioxide in the combustion chamber, the lowest consumption of fuel.

Due to this resistance, promoted by the particle size, the increase in the formation of $CO_2$ by the oxygen donation of the present invention, the results demonstrate lower consumption, in the proposed driving conditions as well as in the adverse controlled conditions involving the tested engines.

For the study of the product, tests were performed, and for this, the cell detector was set at 90 degrees, and the cell temperature was set at 25° C. The thermal equilibrium of the samples was found before the analysis.

The samples were diluted depending on the homogenization, according to Table 1:

TABLE 1

| Dilution of samples | |
|---|---|
| Dilution | |
| unprocessed | Sample diluted 10 times in water |
| Homogenized | Sample diluted 10 times in ethanol |

From this dilution, the values of average Z, initial Zeta Potential (PI), average Zeta Potential and average Electrophoretic Mobility were verified, according to Table 2:

TABLE 2

| mean values of mean Z, Zeta Potential, Electrophoretic Mobility and PI | | | | |
|---|---|---|---|---|
| Sample | Z average (nm) | PI | Average Zeta Potential (mV) | Average Electrophoretic Mobility ($cm^2/Vs$) |
| Unprocessed A | 142.3 | 0.218 | −0.6 | −0.000005 |
| Unprocessed B | 144.4 | 0.247 | −1.7 | −0.000013 |
| Unprocessed C | 145.2 | 0.256 | −0.6 | −0.000004 |
| Average | 144 | 0.24 | −1 | −0.000007 |
| Standard deviation | 1.5 | 0.02 | 0.6 | 0.000005 |

The tables 3 and 4 reveal the average sample sizes and particle concentration in the colloidal dispersion, considering the unprocessed material diluted in water and the material homogenized in ethanol, respectively:

TABLE 3

| unprocessed samples | | | | |
|---|---|---|---|---|
| Sample | D10 [nm] | D50 [nm] | D90 [nm] | Concentration (particles/mL) |
| Unprocessed 1 | 57.71 | 137.92 | 239.82 | 4.29E+08 |
| Unprocessed 2 | 57.04 | 135.16 | 240.52 | 2.13E+08 |
| Unprocessed 3 | 52.8 | 120.89 | 237.22 | 4.24E+08 |
| Average | 55.85 | 131.32 | 239.19 | 4.22E+08 |
| Coefficient of variation (%) | 3.89% | 5.68% | 0.59% | 1.58% |

TABLE 4

| Samples homogenized in ethanol. | | | | |
|---|---|---|---|---|
| Sample | D10 [nm] | D50 [nm] | D90 [nm] | Concentration (particles/mL) |
| Homogenized in ethanol 1 | 61.19 | 112.55 | 184.24 | 4.24E+08 |
| Homogenized in ethanol 2 | 53.56 | 109.74 | 181.72 | 4.28E+08 |
| Homogenized in ethanol 3 | 50.88 | 110.72 | 180.96 | 3.88E+08 |
| Average | 55.21 | 111 | 182.31 | 4.13E+08 |
| Coefficient of variation (%) | 7.91% | 1.05% | 0.77% | 4.35% |

The table 5 presents characteristics and specifications of diesel used, while table 6 presents characteristics and specifications of diesel mixed with a preferred configuration of the additive object of the present invention, for comparison.

TABLE 5 diesel specifications

| Method | Test | Specification limit | Result | Units |
|---|---|---|---|---|
| Appearance | clarity and brightness | clarity and brightness | Approved | |
| | Presence of water and/or particles | No water or particles present | No water or particles present | |
| | Color | No color | | |
| | sample temperature | 20 | | ° C. |
| ENISO12185 | Density at 15° C. | 820.0-845.0 | 833.5 | kg/m$^3$ |
| ENISO3405 | 95% recovery | Max 360 | 357.7 | ° C. |
| | Recovered at 250° C. | Under 65 | 27.4 | %(V/V) |
| | Recovered at 350° C. | Min 85 | 92.4 | %(V/V) |
| ENISO20846 | Sulphur content | Max 10 | 7.2 | mg/kg |
| EN 116 | Cold filter connection point | Max 0 | −18 | ° C. |
| ENISO2719 | Flash point - Proc. A | Over 55 | 58.5 | ° C. |
| ENISO4264 | Calculation of cetane index | Min 46.0 | 56.8 | |
| ENISO5165 | Cetane number | Min 51.0 | 53.4 | |
| EN 12916 | Polycyclic aromatic hydrocarbons | Max 8.0 | 3.1 | % mass |
| EN 14078 | Interval | | B | |
| | FAME (fatty acid methyl ester) content | Max 7.0 | 6.4 | %(V/V) |
| ENISO12937 | Water content | Max 200 | 50 | mg/kg |
| EN 12662 | Filtration result | Complete | | |
| | total contamination | Max 24 | <12.0 | mg/kg |
| ISO 12156 | Procedure used | Procedure A | | |
| | Lubricity (HFRR at 60° C.) | Max 460 | <200 | μm |
| ENISO2160 | Copper corrosion at 50° C./3 hr | Max 1 | 1 | |
| ENISO6245 | Ash content | Max 0.01 | <0.001 | % mass |
| ENISO3104 | Kinematic viscosity at 40° C. | 2.00-4.50 | 3.059 | mm$^2$/s |
| ENISO10370 | Micro carbon residue in 10% residue | Max 0.30 | <0.10 | % mass |
| | method for distillation with 10% residue | Atmospheric Distillation | | |
| ENISO12205 | Oxidation Stability - Total Insolubles | Max 25 | <1 | g/m$^3$ |
| EN 15751 | Oxidation Stability at 110° C. | Min 20 | >20.0 | h |
| EN 16576 | manganese content | Max 2.0 | <0.5 | mg/L |
| EN 23015 | Cloud Point | | −3 | ° C. |

TABLE 6 diesel specifications in conjunction with the additive of the present invention

| Method | Test | Specification limit | Result | Units |
|---|---|---|---|---|
| Appearance | clarity and brightness | clarity and brightness | Approved | |
| | Presence of water and/or particles | No water or particles present | No water or particles present | |
| | Color | No color | | |
| | Sample temperature | 20 | | ° C. |
| ENISO12185 | Density at 15° C. | 820.0-845.0 | 833.5 | kg/m$^3$ |
| ENISO3405 | 95% recovery | Max 360 | 357.7 | ° C. |
| | Recovered at 250° C. | Under 65 | 27.4 | %(V/V) |
| | Recovered at 350° C. | Min 85 | 92.4 | %(V/V) |
| ENISO20846 | Sulphur content | Max 10 | 7.2 | mg/kg |
| EN 116 | Cold filter connection point | Max 0 | −18 | ° C. |
| ENISO2719 | Flash point - Proc. A | Over 55 | 58.5 | ° C. |
| ENISO4264 | Calculation of cetane index | Min 46.0 | 56.8 | |
| ENISO5165 | Cetane number | Min 51.0 | 53.4 | |
| EN 12916 | Polycyclic aromatic hydrocarbons | Max 8.0 | 3.1 | % mass |
| EN 14078 | interval | | B | |
| | FAME (fatty acid methyl ester) content | Max 7.0 | 6.4 | %(V/V) |

TABLE 6-continued diesel specifications in conjunction with the additive of the present invention

| Method | Test | Specification limit | Result | Units |
|---|---|---|---|---|
| ENISO12937 | Water content | Max 200 | 50 | mg/kg |
| EN 12662 | Filtration result | Complete | | |
| | total contamination | Max 24 | <12.0 | mg/kg |
| ISO 12156 | Procedure used | Procedure A | | |
| | Lubricity (HFRR at 60° C.) | Max 460 | <200 | μm |
| ENISO2160 | Copper corrosion at 50° C./3 hr | Max 1 | 1 | |
| ENISO6245 | Ash content | Max 0.01 | <0.001 | % mass |
| ENISO3104 | Kinematic viscosity at 40° C. | 2.00-4.50 | 3.059 | $mm^2/s$ |
| ENISO10370 | Micro carbon residue in 10% residue | Max 0.30 | <0.10 | % mass |
| | method for distillation with 10% residue | Atmospheric Distillation | | |
| ENISO12205 | Oxidation Stability - Total Insolubles | Max 25 | <1 | $g/m^3$ |
| EN 15751 | Oxidation Stability at 110° C. | Min 20 | >20.0 | h |
| EN 16576 | Manganese content | Max 2.0 | <0.5 | mg/L |
| EN 23015 | Cloud Point | | −3 | ° C. |

Table 7 presents the diesel properties when used with additive with 10000 parts of diesel for 1 of additive, while Table 8 presents the properties of pure diesel, for comparison.

TABLE 7 properties of diesel with additive in a ratio of 10000 to 1
Diesel - 10000 for 1

| Method | Test | Result | Units |
|---|---|---|---|
| ASTM | Density of Liquids by Digital Density Meter | | |
| D4052 | API gravity at 60° F. | 39.5 | ° API |
| ASTM | Pensky-Martens Closed-Cup Flashpoint | | |
| D93 | Corrected Flash Point | 62 | ° C. |
| | Corrected Flash Point | 144 | ° F. |
| ASTM | Water and Sediment in Middle Distillate Fuels | | |
| D2709 | (Centrifuge Method) | | |
| | Sediments and water | 0 | Vol % |
| ASTM | Distillation | | |
| D86 | Barometric pressure | 760 | mm Hg |
| | Initial boiling point | 367.4 | ° F. |
| | 5% recovery | 399.3 | ° F. |
| | 10% recovery | 412.4 | ° F. |
| | 20% recovery | 434.1 | ° F. |
| | 30% recovery | 457.8 | ° F. |
| | 40% recovery | 482.2 | ° F. |
| | 50% recovery | 508.3 | ° F. |
| | 60% recovery | 534.7 | ° F. |
| | 70% recovery | 562.9 | ° F. |
| | 80% recovery | 592.6 | ° F. |
| | 90% recovery | 627.7 | ° F. |
| | 95% recovery | 657.7 | ° F. |
| | Final boiling point | 675.7 | ° F. |
| | Residue | 1.3 | Vol % |
| | Corrected loss | 1.1 | Vol % |
| | Corrected recovery | 97.6 | Vol % |
| ASTM | Kinematic/Dynamic Viscosity | | |
| D445 | Kinematic viscosity at 104° F./40° C. | 2.655 | $mm^2/s$ |
| ASTM | Petroleum product ash | | |
| D482 | ashes | <0.001 | % mass |
| ASTM | Determination of Total Sulfur in Light Hydrocarbons, | | |
| D5453 | Spark Ignition Engine Fuel, Diesel Engine Fuel and Engine Oil by Ultraviolet Fluorescence | | |
| | Sulphur content | 4.8 | mg/kg |
| ASTM | Corrosion - Copper Strip | | |
| D130 | Copper corrosion at 50° C. for 3 hrs | 1 | |

TABLE 7-continued properties of diesel with additive in a ratio of 10000 to 1
Diesel - 10000 for 1

| Method | Test | Result | Units |
|---|---|---|---|
| ASTM | Calculated cetane number | | |
| D976 | cetane index | 54.5 | |
| ASTM | Types of hydrocarbons by fluorescent indicator adsorption | | |
| D1319 | Aromatics | 14.8 | Vol % |
| ASTM | Cloud point | | |
| D2500 | Cloud point | −2 | ° C. |
| | Cloud point | 28.4 | ° F. |
| ASTM | Ramsbottom Carbon Waste from Petroleum Products | | |
| D524 | Ramsbottom Carbon Waste (10% Dest.) | 0.06 | % mass |
| | Lubricity by Alternative High Frequency Platform (HFRR) | | |
| ASTM | Main axis | 260 | μm |
| D6079 | Secondary axis | 200 | μm |
| | Diameter of scar or wear mark | 230 | μm |
| ASTM | Electrical Conductivity of Aviation and Distillate Fuels | | |
| D2624 | Temperature | 22 | ° C. |
| | Electric conductivity | 117 | pS/m |

TABLE 8 pure diesel properties
Diesel - Pure

| Method | Test | Result | Units |
|---|---|---|---|
| ASTM | Density of Liquids by Digital Density Meter | | |
| D4052 | API gravity at 60° F. | 39.5 | ° API |
| ASTM | Pensky-Martens Closed-Cup Flashpoint | | |
| D93 | Corrected Flash Point | 62 | ° C. |
| | Corrected Flash Point | 143 | ° F. |
| ASTM | Water and Sediment in Middle Distillate Fuels | | |
| D2709 | (Centrifuge Method) | | |
| | Sediments and water | 0 | Vol % |
| ASTM | Distillation | | |
| D86 | Barometric pressure | 760 | mm Hg |
| | Initial boiling point | 363.3 | ° F. |
| | 5% recovery | 397.1 | ° F. |
| | 10% recovery | 411.4 | ° F. |
| | 20% recovery | 435.6 | ° F. |
| | 30% recovery | 458.6 | ° F. |
| | 40% recovery | 483.8 | ° F. |

TABLE 8-continued

| pure diesel properties Diesel - Pure | | | |
|---|---|---|---|
| Method | Test | Result | Units |
| | 50% recovery | 508.9 | ° F. |
| | 60% recovery | 535.2 | ° F. |
| | 70% recovery | 562.5 | ° F. |
| | 80% recovery | 592.2 | ° F. |
| | 90% recovery | 626.2 | ° F. |
| | 95% recovery | 651.7 | ° F. |
| | Final boiling point | 674.7 | ° F. |
| | Residue | 1.4 | Vol % |
| | Corrected loss | 0.5 | Vol % |
| | Corrected recovery | 98.1 | Vol % |
| ASTM | Kinematic/Dynamic Viscosity | | |
| D445 | Kinematic viscosity @ 104° F./40° C. | 2.618 | $mm^2/s$ |
| ASTM | Petroleum product ash | | |
| D482 | Ashes | <0.001 | % mass |
| ASTM D5453 | Determination of Total Sulfur in Light Hydrocarbons, Spark Ignition Engine Fuel, Diesel Engine Fuel and Engine Oil by Ultraviolet Fluorescence. | | |
| | Sulphur content | 4.8 | mg/kg |
| ASTM | Corrosion - Copper Strip | | |
| D130 | Copper corrosion at 50° C. for 3 hrs | 1 | |
| ASTM | Calculated cetane index | | |
| D976 | Cetane number | 54.6 | |
| ASTM D1319 | Types of hydrocarbons by fluorescent indicator adsorption | | |
| | Aromatics | 15.1 | Vol % |
| ASTM | Cloud point | | |

TABLE 8-continued

| pure diesel properties Diesel - Pure | | | |
|---|---|---|---|
| Method | Test | Result | Units |
| D2500 | Cloud point | −2 | ° C. |
| | Cloud point | 28.4 | ° F. |
| ASTM D524 | Ramsbottom Carbon Waste from Petroleum Products | | |
| | Ramsbottom Carbon Waste (10% Dest.) | 0.08 | % mass |
| ASTM D6079 | Lubricity by Alternative High Frequency Platform (HFRR) | | |
| | Main axis | 250 | μm |
| | Secondary axis | 160 | μm |
| | Wear scar diameter | 200 | μm |
| ASTM D2624 | Electrical Conductivity of Aviation and Distillate Fuels | | |
| | Temperature | 23 | ° C. |
| | Electric conductivity | 143 | pS/m |

Consumption and emission tests were carried out on a vehicle loaded with a mass of 65000 lbs. (29483.5 Kg), using a Cummins ISX 435ST 2009 engine from family 9CEXH0912XAK. Tests were performed with a standard control diesel fuel (CARB), an alternative configuration of the present invention (Fuel Matrix 1), with a concentration of 45 mL per 50 gallons of diesel and a preferred configuration of the present invention (Fuel Matrix 2), with a concentration of 32 mL per 40 gallons of diesel. Table 9 presents the results in grams per mile while Table 10 presents the result in grams per horse hour (g/bhp-hr).

TABLE 9

| test results in grams per mile | | | | | | | | | |
|---|---|---|---|---|---|---|---|---|---|
| Fuel | Date | test number | tracing | THC | CH4 | CO | NOx | CO2 | PM |
| CARB | Dec. 11, 2015 | 1 | HHDDT Cruise HI-SP | 0.053 | 0.012 | 0.003 | 17,870 | 1903 | 0.0057 |
| | Dec. 11, 2015 | 2 | HHDDT Cruise HI-SP_x3_1 | 0.022 | 0.010 | 0.003 | 18,258 | 1914 | 0.0007 |
| | Dec. 11, 2015 | 3 | HHDDT Cruise HI-SP_x3_2 | 0.019 | 0.013 | 0.004 | 18,379 | 1924 | 0.0007 |
| | Dec. 11, 2015 | 4 | HHDDT Cruise HI-SP_x3_3 | 0.020 | 0.014 | 0.003 | 17,754 | 1904 | 0.0007 |
| | Nov. 13, 2015 | 5 | HHDDT Cruise HI-SP_x2_1 | 0.010 | 0.002 | 0.003 | 6.365 | 1888 | 0.0013 |
| | Nov. 13, 2015 | 6 | HHDDT Cruise HI-SP_x2_2 | 0.060 | 0.012 | 0.004 | 14,944 | 2041 | 0.0013 |
| | | | Average | 0.031 | 0.011 | 0.003 | 15,595 | 1929 | 0.0017 |
| | | | Standard deviation | 0.021 | 0.004 | 0.000 | 4,697 | 56 | 0.0020 |
| Fuel Matrix 1 | Dec. 11, 2015 | 1 | HHDDT Cruise HI-SP_x3_2 | 0.073 | 0.004 | 0.003 | 7,679 | 1811 | AT |
| | Dec. 11, 2015 | 2 | HHDDT Cruise HI-SP_x3_3 | 0.028 — | 0.006 | 0.003 | 8,234 | 1848 | AT |
| | Dec. 11, 2015 | 3 | HHDDT Cruise HI-SP | 0.024 | 0.018 | 0.004 | 5,896 | 1979 | 0.0028 |

TABLE 9-continued test results in grams per mile

| Fuel | Date | test number | tracing | THC | CH4 | CO | NOx | CO2 | PM |
|---|---|---|---|---|---|---|---|---|---|
| | Dec. 11, 2015 | 4 | HHDDT Cruise HI-SP_x3_1 | 0.021 | 0.009 | 0.004 | 6,040 | 1934 | AT |
| | Dec. 11, 2015 | 5 | HHDDT Cruise HI-SP_x3_2 | 0.015 | 0.007 | 0.003 | 7,040 | 1820 | AT |
| | | | Average | 0.032 | 0.009 | 0.003 | 6,978 | 1878 | 0.0028 |
| | | | Standard deviation | 0.023 | 0.006 | 0.000 | 1.015 | 74 | 0.0000 |
| Fuel Matrix 2 | Nov. 13, 2015 | 1 | HHDDT Cruise HI-SP_x2_1 | 0.037 | 0.006 | 0.003 | 5.812 | 1867 | 0.0010 |
| | Nov. 13, 2015 | 2 | HHDDT Cruise HI-SP_x2_2 | 0.022 | 0.009 | 0.003 | 7,661 | 1794 | 0.0010 |
| | Nov. 13, 2015 | 3 | HHDDT Cruise HI-SP_x2_1 | 0.018 | 0.003 | 0.003 | 5.735 | 1923 | 0.0003 |
| | Nov. 13, 2015 | 4 | HHDDT Cruise HI-SP_x2_2 | 0.015 | 0.007 | 0.003 | 7,279 | 1826 | 0.0003 |
| | | | Average | 0.023 | 0.006 | 0.003 | 6,622 | 1853 | 0.0006 |
| | | | Standard deviation | 0.010 | 0.003 | 0.000 | 0.992 | 56 | 0.0004 |
| summary | | % Difference | Fuel Matrix 1 for CARB | 4.68% | −15.00% | −1.43% | −55.26% | −2.62% | 58.14% |
| | | | Fuel Matrix 2 for CARB | −24.70% | −39.08% | −5.06% | −57.54% | −3.96% | −63.74% |
| | | TTEST | Fuel Matrix 1 for CARB | 0.916 | 0.612 | 0.485 | 0.003 | 0.231 | AT |
| | | | Fuel Matrix 2 for CARB | 0.518 | 0.134 | 0.030 | 0.006 | 0.068 | 0.308 |

TABLE 10 test results in g/bhp-hr (grams per horse per hour)

| Fuel | Date | test number | tracing | THC | CH4 | CO | NOx | CO2 | PM |
|---|---|---|---|---|---|---|---|---|---|
| CARB | Dec. 11, 2015 | 1 | HHDDT Cruise HI-SP | 0.02 | 0.005 | 0.001 | 6.694 | 713 | 0.0021 |
| | Dec. 11, 2015 | 2 | HHDDT Cruise HI-SP_x3_1 | 0.008 | 0.004 | 0.001 | 6.805 | 713 | 0.0003 |
| | Dec. 11, 2015 | 3 | HHDDT Cruise HI-SP_x3_2 | 0.007 | 0.005 | 0.001 | 6.65 | 696 | 0.0003 |
| | Dec. 11, 2015 | 4 | HHDDT Cruise HI-SP_x3_3 | 0.007 | 0.005 | 0.001 | 6.49 | 696 | 0.0003 |

TABLE 10-continued test results in g/bhp-hr (grams per horse per hour)

| Fuel | Date | test number | tracing | THC | CH4 | CO | NOx | CO2 | PM |
|---|---|---|---|---|---|---|---|---|---|
| | Nov. 13, 2015 | 5 | HHDDT Cruise HI-SP_x2_1 | 0.004 | 0.001 | 0.001 | 2.27 | 673 | 0.0005 |
| | Nov. 13, 2015 | 6 | HHDDT Cruise HI-SP_x2_2 | 0.022 | 0.004 | 0.001 | 5.415 | 740 | 0.0005 |
| | | | Average | 0.011 | 0.004 | 0.001 | 5.721 | 705 | 0.0006 |
| | | | Standard deviation | 0.008 | 0.002 | 0 | 1.765 | 22 | 0.0007 |
| Fuel Matrix 1 | Dec. 11, 2015 | 1 | HHDDT Cruise HI-SP_x3_2 | 0.025 | 0.002 | 0.001 | 2.69 | 634 | AT |
| | Dec. 11, 2015 | two | HHDDT Cruise HI-SP_x3_3 | 0.01 | 0.002 | 0.001 | 2.89 | 649 | AT |
| | Dec. 11, 2015 | 3 | HHDDT Cruise HI-SP | 0.008 | 0.006 | 0.001 | 1.913 | 642 | 0.0009 |
| | Dec. 11, 2015 | 4 | HHDDT Cruise HI-SP_x3_1 | 0.007 | 0.003 | 0.001 | 2.018 | 646 | AT |
| | Dec. 11, 2015 | 5 | HHDDT Cruise HI-SP_x3_2 | 0.005 | 0.003 | 0.001 | 2.47 | 638 | AT |
| | | | Average | 0.011 | 0.003 | 0.001 | 2.396 | 642 | 0.0009 |
| | | | Standard deviation | 0.008 | 0.002 | 0 | 0.422 | 6 | 0 |
| Fuel Matrix 2 | Nov. 13, 2015 | 1 | HHDDT Cruise HI-SP_x2_1 | 0.013 | 0.002 | 0.001 | 1.997 | 641 | 0.0003 |
| | Nov. 13, 2015 | 2 | HHDDT Cruise HI-SP_x2_2 | 0.008 | 0.003 | 0.001 | 2.767 | 648 | 0.0003 |
| | Nov. 13, 2015 | 3 | HHDDT Cruise HI-SP_x2_1 | 0.006 | 0.001 | 0.001 | 1.928 | 647 | 0.0001 |
| | Nov. 13, 2015 | 4 | HHDDT Cruise HI-SP_x2_2 | 0.005 | 0.002 | 0.001 | 2.549 | 639 | 0.00001 |
| | | | Average | 0.008 | 0.002 | 0.001 | 2.31 | 644 | 0.00002 |
| | | | Standard deviation | 0.003 | 0.001 | 0 | 0.412 | 4 | 0.00001 |
| summary | | % Difference | Fuel Matrix 1 for CARB | −1.78% | −22.02% | −7.86% | −58.12% | −8.97% | 38.88% |
| | | | Fuel Matrix 2 for CARB | −28.73% | −41.70% | −9.75% | −59.61% | −8.69% | −65.64% |
| | | TTEST | Fuel Matrix 1 for CARB | 0.967 | 0.424 | 0.001 | 0.003 | 0 | AT |
| | | | Fuel Matrix 2 for CARB | 0.452 | 0.114 | 0 | 0.006 | 0.001 | 0.302 |

The product, in a preferred configuration, has a composition according to Table 11:

TABLE 11 additive composition in a preferred configuration

| Ingredients | Percentage of Components |
|---|---|
| Ethanol | 93.95% |
| Methanol | 4.73% |
| Hydrogen Peroxide | 1.09% |
| Water | 0.23% |

The product, in a preferred configuration, has the characteristics described in the tables 12 and 13:

TABLE 12

Flash, auto-ignition, and boiling temperatures

| Feature | Temperature (° C.) | Temperature (° F.) |
|---|---|---|
| Flash point (closed chamber) | 15 | 59 |
| Self-ignition | 385-450 | 725-842 |
| Boiling point | 76.6 | 169 |

TABLE 13 additional product features

| | |
|---|---|
| Lower limit of flammables in air | 2.2% |
| Upper limit of flammables in air | 36% |
| Color | Colorless |
| Specific gravity | 0.8081 |
| Volatility by volume (%) | 100% |
| Evaporation rate (%) | 1.7 |
| Solubility | Partially soluble in water |
| Viscosity | 20 cPs |
| Molecular weight (Dalton) | 450 |

Tests to verify the lubricity of the additive were also carried out. Table Table 14 reveals the equipment used while the table 15 reveals the parameters applied to the test samples.

TABLE 14 equipment and parameters of test samples

| Parameter | Value |
|---|---|
| Instrument | Agilent 7700x ICP-MS |
| sample introduction | Concentric glass nebulizer with 0.25 mm diameter. 700 mm long capillary tube; Quartz torch with 1.5 mm diameter injector |
| sample capture | Self-aspiration |
| Interface | Platinum-tipped sampling cone and skimmer cone |
| Autosampler | Agilent I-AS |

TABLE 15 usage and sample parameters

| Cell mode | | | $H_2$ | He |
|---|---|---|---|---|
| | Stabilization time | Seconds | 5 | 30 |
| Plasma | RF power | W | 1600 | |
| | Sampling depth | mm | 8 | |
| | Carrier gas | L/min | 0.6 | |
| Auxiliary Gas | 20% $O_2$ + 80% Air | L/min | 0.4 | |
| | Spray chamber temperature | ° C. | −5 | |

TABLE 15-continued usage and sample parameters

| Cell mode | | | $H_2$ | He |
|---|---|---|---|---|
| Lens settings | Extract 1 | V | 0 | |
| | Extract 2 | V | −100 | |
| | Omega bias | V | −55 | |
| | Omega lenses | V | 6.3 | |
| | Cell input | V | −40 | |
| | Cell output | V | −70 | −150 |
| | Deflection | V | −2.4 | −70 |
| | plate bias | V | −60 | −150 |
| Cell | $H_2$ flow | mL/min | 6 | |
| | He flow | mL/min | | 10 |
| | Octopole bias | V | −20 | −100 |
| | Energy discrimination | V | 5 | 10 |
| Measurements | Integration time | seconds | 0.66 and 3 | |
| | ISTD | | Yttrium | |

Tests to check the materials in the diesel and additive mix were carried out to see if tHe could influence engine operation in a harmful way. Table 16 reveals the mass/charge ratio (m/z) of the ions in the gaseous state, as well as the limits of detection (DL) and their concentration or equivalent background concentration (BEC), in parts per billion. Table 17 reveals the concentration of metal impurities in common fuels, also in parts per billion. Table 18 presents the residues obtained according to the NIST SEM 1634c norm or standard.

TABLE 16 ions in gaseous state and their concentration

| | m/z | Mode | DL (ppb) | BEC (ppb) |
|---|---|---|---|---|
| B | 10 | $H_2$ | 0.85 | 2.1 |
| Na | 23 | $H_2$ | 0.41 | 2.8 |
| Mg | 24 | $H_2$ | 0.59 | 0.66 |
| Al | 27 | He | 0.03 | 0.11 |
| Ca | 40 | $H_2$ | 0.42 | 0.68 |
| Ca | 44 | $H_2$ | 0.63 | 0.6 |
| Ti | 49 | He | 0.14 | 0.01 |
| V | 51 | He | 0.005 | 0.01 |
| Cr | 52 | $H_2$ | 0.045 | 0.16 |
| Fe | 54 | $H_2$ | 0.11 | 0.078 |
| Mn | 55 | He | 0.01 | 0.005 |
| Ni | 60 | He | 0.02 | 0.02 |
| Cu | 63 | He | 0.05 | 0.26 |
| Zn | 66 | He | 0.21 | 0.33 |
| Zn | 67 | He | 0.33 | 0.29 |
| Mo | 95 | He | 0.005 | 0.005 |
| Ag | 107 | He | 0.01 | 0.01 |
| Cd | 114 | He | 0.005 | 0.01 |
| Sn | 118 | He | 0.005 | 0.01 |
| Ba | 137 | $H_2$ | 0.018 | 0.008 |
| Pb | 208 | He | 0.005 | 0.01 |

TABLE 17

Concentration of metal impurities in different fuels

| | | Kerosene* | Alcohol** | White gasoline A** | White gasoline B** | Diesel oil* | Regular gasoline* | High octane gasoline* |
|---|---|---|---|---|---|---|---|---|
| $^{10}B$ | $H_2$ | na | 920 | 16 | 25 | 1.5 | 5 | na. |
| $^{23}Na$ | $H_2$ | na | 19 | na | 25 | 4.1 | na | na. |
| $^{24}Mg$ | $H_2$ | na | 5.2 | 3.6 | 37 | 6.6 | 2.6 | na. |
| $^{27}Al$ | He | 0.4 | 8 | na | 31 | 8.3 | 1.4 | na. |
| $^{40}Ca$ | $H_2$ | 0.3 | 6.4 | 3 | 42 | 10 | 11 | 0.3 |
| $^{48}Ti$ | He | 0.1 | 0.9 | 0.2 | 33 | 8.1 | 1.8 | 0.2 |
| $^{51}V$ | He | 0.5 | 0.5 | 0.4 | 31 | 7.7 | 1.4 | 0.9 |
| $^{52}Cr$ | $H_2$ | 0.1 | 1.8 | 1.3 | 37 | 8 | 1.9 | 0.3 |
| $^{55}Mn$ | $H_2$ | 0.3 | 2.6 | 1.3 | 36 | 8 | 2.2 | 0.4 |
| $^{54}Fe$ | $H_2$ | 1.2 | 41 | 0.6 | 39 | 8.9 | 10 | 0.6 |
| $^{59}Co$ | He | 0.2 | 1.1 | 0.1 | 0.9 | 0.3 | 0.2 | 0.4 |
| $^{60}Ni$ | He | 0.4 | 2 | 0.9 | 30 | 6.44 | 1.9 | 0.1 |
| $^{63}Cu$ | He | 2.1 | 14 | 4.8 | 41 | 7.4 | 2.8 | 0.5 |
| $^{66}Zn$ | He | 58 | 78 | 8.2 | 35 | 52 | 250 | 3.6 |
| $^{95}Mo$ | He | 0.1 | 0.6 | 0.2 | 31 | 6.9 | 1.5 | 0.3 |
| $^{107}Ag$ | He | 0.1 | 4.7 | 0.1 | 27 | 6.8 | 1.5 | 0.2 |
| $^{114}Cd$*** | He | 0.1 | 12 | 0.5 | 30 | 6.4 | 1.5 | 0.3 |
| $^{118}Sn$ | He | na | 610 | 3.8 | 36 | 7.4 | 2 | 0.2 |
| $^{138}Ba$ | $H_2$ | 0.9 | 0.2 | 0.1 | 30 | 8.4 | 17 | 0.4 |
| $^{208}Pb$ | He | 0.3 | 0.9 | 0.4 | 27 | 6.6 | 1.6 | 0.4 |

*Purchased at a gas station.

**Purchased at a camping gear store.

***Comparable performance was obtained with the isotope Cd 111, which is the preferred normal isotope for Cd. However, in this application, since Sn levels are low in fuel/lube oil samples, we used data from the more abundant Cd 114 isotope, which provided greater sensitivity and slightly improved DLs.

TABLE 18 concentration of impurities according to NIST SEM 1634c

| Element | Reference mg/kg | result mg/kg |
|---|---|---|
| Na | 37 | 37.7 |
| V | 28 | 28 |
| Co | 0.15 | 0.147 |
| Ni | 17 | 17.2 |
| As | 0.14 | 0.148 |
| Se | 0.1 | 0.102 |
| Ba | 1.8 | 1.87 |

The present invention had its result verified in tested equipment, which were duly measured in accordance with current ABNT and Inmetro standards. The fuels used are those of normal daily use for all users, and as the engines tested are within the emission norms and use well-known standards such as EURO 4 and EURO 5.

Remembering that the combustion reaction forms $CO_2$ and water, the water which is responsible for the direct action of pressure on the combustion system.

The sequence of energy formed the increase in the presence of electronic charges of oxygen in the medium are the reason for the increase in the formation of $CO_2$.

We reinforce that the present invention does not transform into its electrolysis action the nanometric dispersion duly irradiated when the temperature and pressure action directly into $CO_2$, but an oxygen donation agent to increase the formation of $CO_2$ together with the air and the hydrocarbons of the fuel.

The present invention in the proposed range of pH and in the time of irradiation and subsequent electrolysis and in function of the metal ions in solution promote, for the most part, above 75% of the reactions of hydrated electrons with oxygen, forming $O_{-2}$, in the present invention due to metal ions in an acidified mineral system, reactions reach more than 80%. Keeping the pH in the range of 5 to 5.5.

In the combustion chamber, efficiency is greater due to the hydrogen atoms and hydroxyl radicals of the alcohol molecule tending to react with the saturated organic part of the fuel.

The present invention, as already described, allows the reaction of nitrogen compounds with hydrated compounds, thus generating NH2.

The suitable concentration of the present invention as a function of its particle size in the range of 80 to 100 nm is of the order of 1:10,000 on fuels, or 0.001% or 100 ppm. Such concentration promotes a greater balance when combustion is started and better performance.

We consider all the reactions in the formation of the $O^{-2}$ radical, as first order, it is fundamental that the reaction of irradiation via UV in a super oxidant solution, works with pure water, in amounts inferior to 10%.

That the first reaction is the increase of the hydroxyl group and then the increase in the formation of $O^{-2}$, so when the reaction is carried out under pressure and temperature in the combustion chamber, we will obtain a greater amount of oxygen ions in contact with the oxygen in the air forming with the fuel higher amount of $CO_2$.

Briefly, the process in question involves particle size reduction, followed by irradiation in a super oxidant solution, followed by immersion in a slightly acid mineral solution and electrolysis in a slightly acid ionic solution.

The product resulting from this process is an oxygen donor solution when associated with the pressure and temperature present in internal combustion systems such as those present in mechanical energy generation systems.

The present invention reveals new intermolecular forces (dipole-dipole) as well as hydrogen bonds that incorporate O2(−2) (negatively charged −2 oxygen) into the fuel. The mechanism of action occurs at the beginning of the combustion process when the fuel composed of aromatic, naphthenic and saturated chains begin their reactions. Part of the chains start their reactions from 90° C. to temperatures above 250° C., in the highest concentration of saturated and naphthenic chains.

The incorporation of oxygen with negative charge −2 together with the fuel, considering the mass balance with unaltered air, means that the present invention increases the amount of oxygen in the combustion reaction, enhancing the formation of $CO_2$ and, therefore, increasing the energy produced during combustion. As this will increase the efficiency of the oxidation process, less CO and unburned hydrocarbons are produced during combustion.

At the same time, due to its high negative charge (polarity), the fuel mixed with the present invention repels nitrogen molecules during combustion, until the moment when the nitrogen molecule in the air begins to form nitrous hydrocarbons, $NH_2$ together with the fuel molecule. Oxygen and $NH_2$ are increasing lubricity during combustion.

The increased formation of $CO_2$ in the combustion chamber reduces fuel consumption and consequently reduces emissions of $CO_2$/km. The increase in the reaction of $CO+\frac{1}{2}O_2 \Rightarrow CO_2$ with the formation of water vapor is increasing the system pressure.

This $CO_2$ concentration process reduces the formation of NOx by up to 70%, reduces consumption by up to 15% and reduces the formation of particulate matter by more than 70%.

The process of the present invention results in an ionized nanometer colloidal dispersion that, when mixed with liquid fossil fuel, creates a nanometer colloidal dispersion of fuel, with hydrocarbons generating macromolecules.

The present invention transfers the polarity to liquid fuel. In the production process, the polarity and size of the particles are controlled, in addition to creating resistance to the pressures inside a combustion chamber. In this way, the present invention results in a product with electronic stability.

With their new charge, the fuel molecules repel the nitrogen molecules during the combustion reaction. Nitrogen does not take as much energy from the combustion reaction through the endothermic process of creating NOx, and combustion releases more useful working energy and less harmful emissions.

In complete combustion, if all the carbon in the fuel is burned and transformed into $CO_2$, all the hydrogen is transformed into $H_2O$, and all the sulfur (if present) is transformed into $SO_2$.

In incomplete combustion, the result of combustion still has unburned fuel or components such as C, $H_2$, CO or OH.

Reasons for incomplete combustion are insufficient oxygen, insufficient mixing in the combustion chamber during mixing of fuel and oxygen, and dissociation at high temperatures.

Oxygen has a much greater tendency to combine with hydrogen than with carbon. That said, the hydrogen in the fuel is normally completely transformed, generating $H_2O$.

The stoichiometry of octane combustion occurs as follows:

$$C_8H_{18} + a\ O_2 + b\ N_2 = c\ CO_2 + d\ H_2O + e\ N_2 \quad \text{(I)}$$

Wherein, the letters a, b, c, d and e represent the equilibrium of the reaction, resulting in a=12.5, b=47, c=8, d=9 and e=47.

Starting from reaction (I), it is possible to determine the masses of the reaction. The molecular mass of air (M_air) is 28.97 kg/kmol, while the mass of octane (M_octane) is 114 kg/kmol. Air (AC moles) is composed by the sum of the amount of moles of oxygen and hydrogen which results in 59.5. The fuel ratio (AC mass) is 15.12 moles.

$$\text{AC_moles} = a + b \quad \text{(II)}$$

$$\text{AC_mass} = \text{AC_moles} * \frac{\text{M_air}}{\text{M_octane}} \quad \text{(III)}$$

In fuel oxidation, in which hydrogen, oxygen, gasoline ($C_8H_{18}$), diesel ($C_{12}H_{26}$) and ethanol ($C_2H_6O$) are used. Combustion does not occur with pure oxygen. In combustible air, we consider 21% oxygen and 79% nitrogen, resulting in a ratio between nitrogen and oxygen equivalent to 3.76. Resulting in a molar mass of air of 28.97 kg/kmol.

The luminosity test was carried out under the following conditions: engine speed: 1200 rpm; injection duration: 3500 μs (input), 3437 μs (actual); injection pressure: 180 MPa; nozzle configuration: 2×0.110 mm×140°; ducts: D2L12G1.6$^{\delta}$* vs. D2L12G3$^{\delta}$* vs. none; moment of initiation of combustion: top dead center (0 CAD); dilution: 21 and 16% of moles of oxygen; absolute pressure in the intake manifold: 2.0 bar; intake manifold temperature: 90° C.; cooling temperature: 90° C.; start of injection (crankshaft angle values after top dead center) for 16% oxygen: conventional diesel combustion: −2.69, D2L12G3$^{\delta}$: −3.55 and D2L12G1.6$^{\delta}$: −3.52; start of injection (crankshaft angle values after top dead center) for 21% oxygen: conventional diesel combustion: −1.66, D2L12G3$^{\delta}$: −2.52 and D2L12G1.6$^{\delta}$: −2.33.

Figure 12:
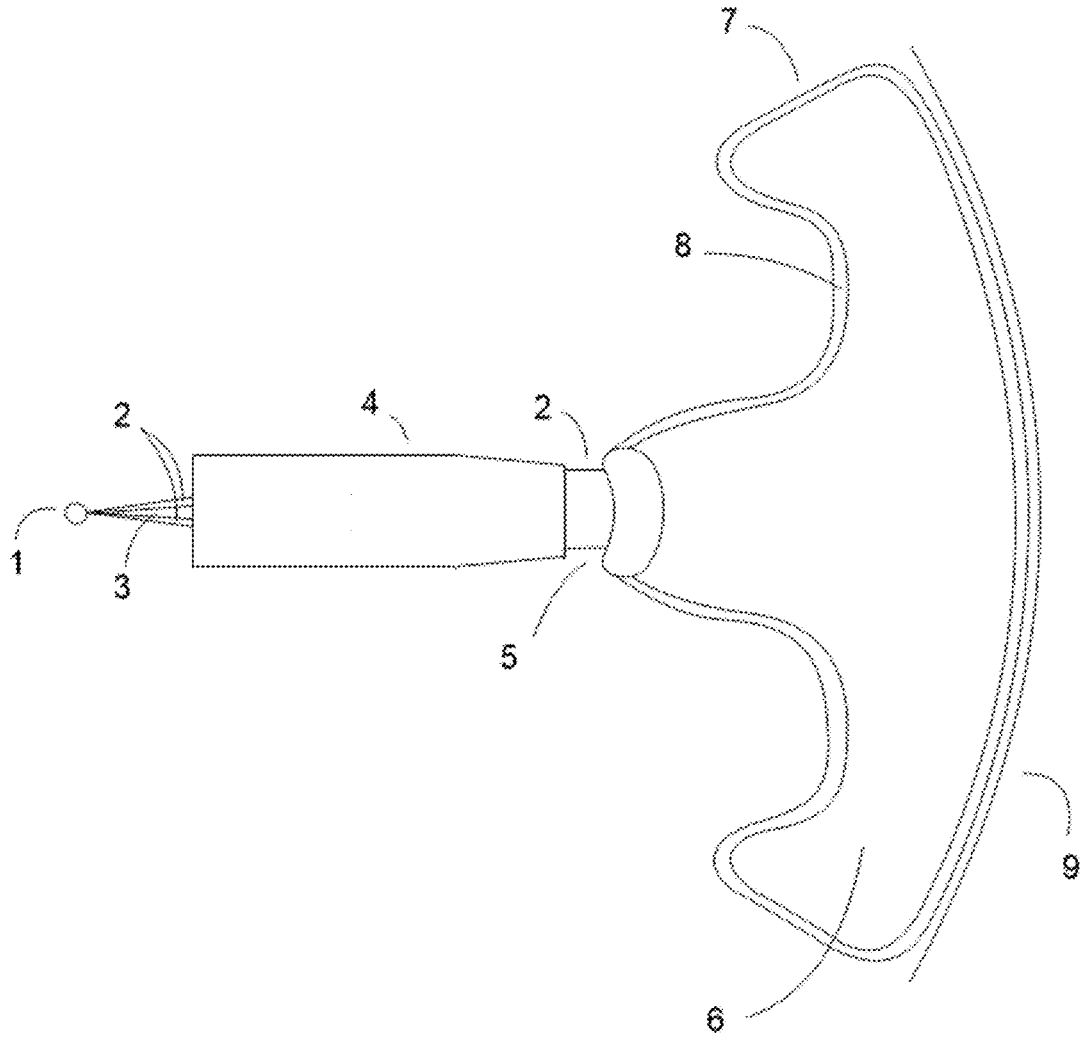
FIG. 12 shows a schematic representation of fuel injection with additive in the combustion chamber.

FIG. 12 reveals an illustration or schematic representation of the fuel spray. The injector nozzle 1 releases, in the form of jets, liquid fuel 2 and a mixture of fuel vapor and air 3.

Liquid fuel 2 and fuel vapor and air mixture 3 then enter duct 4. Duct 4 is configured to direct liquid fuel 2 and fuel vapor 3 into the combustion chamber.

Upon entering the combustion chamber, given its pressure characteristics, there is the self-ignition zone 5. After the self-ignition zone 5, combustion takes place.

In combustion, it is possible to verify the formation of three zones. A zone with a rich combustion product or mixture 6, flame diffusion 8 and a thermally unproductive zone 7.

Figure 13:
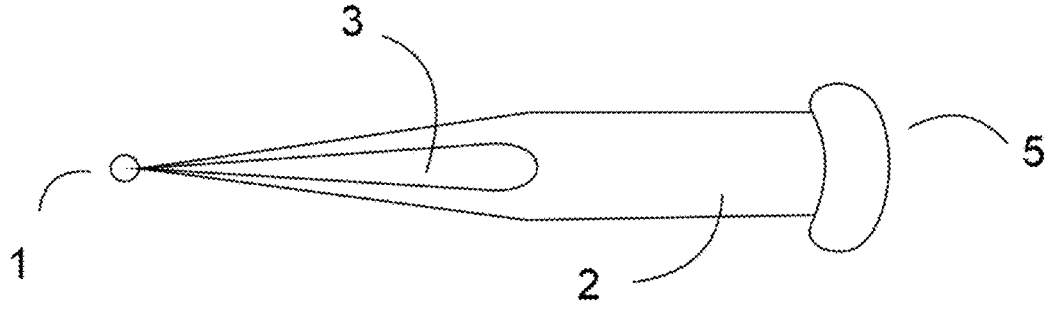
FIG. 13 represents the distribution of liquid fuel and fuel vapor as it leaves the injection nozzle and passes through the duct to the combustion chamber.

FIG. 13 shows the behavior of the liquid fuel 2 and the mixture of fuel vapor and air 3 inside the duct 4, starting from the injection nozzle 1 to the auto-ignition zone 5.

The invention claimed is:

1. A method for producing a fuel additive comprising the following steps:

a) mixing alcohol in water to form a mixture;

b) homogenizing the mixture from step a) under mechanical waves;

c) adding an oxidizing solution to the mixture in step b);

d) applying electromagnetic radiation to a product of step (c);

e) adding a molecular sieve with to a product of step (d) and performing electrolysis;

f) applying microwave spectrum radiation to a product of step (e);

g) atomizing a product of step (f) into a solution of polymeric alcohols having at least four carbon atoms in the repeating unit.

2. The method for producing a fuel additive, according to claim 1, wherein the alcohol concentration in the mixture of step a) is between 99 and 96% by volume.

3. The method for producing a fuel additive, according to claim 1, wherein the pressure used in step b) is between 300 and 700 ATM.

4. The method for producing a fuel additive, according to claim 1, wherein the oxidizing solution in step c) is hydrogen peroxide.

5. The method for producing a fuel additive, according to claim 4, wherein the concentration of hydrogen peroxide in the solution in step c) is between 0.5 and 5% by volume.

6. The method for producing a fuel additive, according to claim 1, wherein the energy deposited via UV in step d) is between 180 and 380 nm at frequencies reaching up to $10^{18}$ Hz, and the energy is deposited by beams at a distance equal to or less than 50 cm.

7. The method for producing a fuel additive, according to claim 1, wherein the electrolysis of step e) is carried out in an acidic medium at a pH in the range of 3.5 to 6.5.

8. The method for producing a fuel additive, according to claim 7, wherein the electrolysis of step e) is carried out using a cathode made of palladium and an anode made of platinum.

9. The method for producing a fuel additive, according to claim 1, wherein the microwave spectrum radiation applied in step f) has a wavelength between 200 and 300 nm at a frequency of 300 to 800 MHz, wherein microwave spectrum radiation is deposited in the form of a beam applied to the homogenized solution at a distance equal to or less than 50 cm.

10. The method for producing a fuel additive, according to claim 1, wherein the atomization of step g) occurs into a solution of polymeric alcohols having molecular weights between 700 and 3000 Dalton.

* * * * *